US008441421B2

(12) United States Patent
Han et al.

(10) Patent No.: US 8,441,421 B2
(45) Date of Patent: May 14, 2013

(54) PIXEL AND ORGANIC LIGHT EMITTING DISPLAY DEVICE USING THE SAME

(75) Inventors: Sam-Il Han, Yongin (KR); Ki-Myeong Eom, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 238 days.

(21) Appl. No.: 12/963,561

(22) Filed: Dec. 8, 2010

(65) Prior Publication Data

US 2012/0019504 A1 Jan. 26, 2012

(30) Foreign Application Priority Data

Jul. 20, 2010 (KR) ..... 10-2010-0069934

(51) Int. Cl.
*G09G 3/32* (2006.01)

(52) U.S. Cl.
USPC ..... 345/82

(58) Field of Classification Search ..... 345/76–83, 345/211–215, 204
See application file for complete search history.

(56) References Cited

U.S. PATENT DOCUMENTS

2008/0036371 A1* 2/2008 Kim ..... 313/504
2008/0211796 A1* 9/2008 Kim ..... 345/204

FOREIGN PATENT DOCUMENTS

KR 10-2003-0081919 10/2003
KR 10-2005-0005646 1/2005
KR 10-2009-0048823 5/2009
KR 10-2009-0057484 6/2009

* cited by examiner

*Primary Examiner* — Liliana Cerullo
(74) *Attorney, Agent, or Firm* — Christie, Parker & Hale, LLP

(57) ABSTRACT

A pixel includes an OLED coupled to a second power supply, a first transistor coupled to a first power supply for controlling current through the OLED, a second transistor coupled between a data line and the first transistor, third transistors coupled between a gate electrode and a second electrode of the first transistor, the second and third transistors configured to be turned on when the scanning signal is supplied to the i-th scanning line, fourth transistors coupled between an initial power supply and the first transistor, and configured to be turned on when the scanning signal is supplied to an i−1-th scanning line, a first capacitor coupled between the first power supply and the first transistor, and a second capacitor with a first terminal coupled to nodes between two of the third transistors and two of the fourth transistors, and a second terminal coupled to the first power supply.

12 Claims, 3 Drawing Sheets

PIXEL AND ORGANIC LIGHT EMITTING DISPLAY DEVICE USING THE SAME

CROSS-REFERENCE TO RELATED APPLICATION

This application claims priority to and the benefit of Korean Patent Application No. 10-2010-0069934, filed on Jul. 20, 2010, in the Korean Intellectual Property Office, the entire content of which is incorporated herein by reference.

BACKGROUND

1. Field

Aspects of embodiments according to the present invention relate to a pixel and an organic light emitting display device using the same.

2. Description of Related Art

Recently, a variety of flat panel displays that makes it possible to reduce the faults, the weight, and the volume of cathode ray tubes, has been developed. Typical flat panel displays are liquid crystal displays, field emission displays, plasma display panels, organic light emitting display devices, and the like.

Organic light emitting display devices display an image using organic light emitting diodes, which emit light by recombination of electrons and holes, have high response speed, and are driven at low power consumption.

An organic light emitting display device includes a plurality of pixels that are arranged in a matrix-type configuration and are located at the crossing regions of a plurality of data lines, scanning lines, and power supply lines. Each of the pixels generally includes an organic light emitting diode, a driving transistor for controlling an amount of current that flows to the organic light emitting diode, a storage capacitor for charging voltage in response to a data signal, and a compensation circuit for compensating for a threshold voltage of the driving transistor.

The pixels charge voltage corresponding to the data signal and the threshold voltage of the driving transistor in the storage capacitor, and apply current in response to the charged voltage to the organic light emitting diode, so that the pixels display an image (e.g., a fixed image).

SUMMARY

An aspect of embodiments according to the present invention provides a pixel that can display an image having a desired luminance by minimizing or reducing a leakage current, and an organic light emitting display device using the same.

In order to achieve the foregoing and/or other aspects of the present invention, according to one embodiment of the present invention, there is provided a pixel including an organic light emitting diode including a cathode electrode coupled to a second power supply, a first transistor including a first electrode coupled to a first power supply, a second electrode, and a gate electrode, the first transistor being for controlling an amount of current that flows to the second power supply through the organic light emitting diode from the first power supply, a second transistor coupled between a data line and the first electrode of the first transistor, and configured to be turned on when a scanning signal is supplied to an i-th scanning line, where "i" is a natural number, a plurality of third transistors coupled between the gate electrode of the first transistor and the second electrode of the first transistor, and configured to be turned on when the scanning signal is supplied to the i-th scanning line, a plurality of fourth transistors coupled between an initial power supply and the gate electrode of the first transistor, and configured to be turned on when the scanning signal is supplied to an i−1-th scanning line, a first capacitor coupled between the first power supply and the gate electrode of the first transistor, and a second capacitor including a first terminal coupled to a first node between two of the third transistors and to a third node between two of the fourth transistors, and a second terminal coupled to the first power supply.

The pixel may further include a fifth transistor coupled between the first power supply and the first electrode of the first transistor, and configured to be turned on at a time different than times when the second transistor and the fourth transistors are turned on, and a sixth transistor may be coupled between the organic light emitting diode and the second electrode of the first transistor, and may be configured to be turned on and off together with the fifth transistor.

The pixel may further include a seventh transistor including a first electrode coupled to the first power supply, and a second electrode coupled to a fourth node between two of the third transistors and to a fifth node between two of the fourth transistors, the seventh transistor may be configured to be turned on at a time different than times the second transistor and the fourth transistors are turned on.

A second node between two of the third transistors and the fourth node may be electrically isolated from each other when the third transistors are turned off.

The third node and the fifth node may be electrically isolated from each other when the fourth transistors are turned off.

In order to achieve the foregoing and/or other aspects of the present invention, according to another embodiment of the present invention, there is provided an organic light emitting display device including a scan driver for supplying a scanning signal to scanning lines and for supplying an emission control signal to emission control lines, a data driver for supplying a data signal to data lines, and pixels located at crossing regions of the scanning lines and the data lines, wherein an i-th pixel on an i-th horizontal line, "i" being a natural number, includes an organic light emitting diode including a cathode electrode coupled to a second power supply, a first transistor for controlling an amount of current that flows to the second power supply through the organic light emitting diode from a first power supply coupled to a first electrode of the first transistor, a second transistor coupled between a corresponding data line of the data lines and the first electrode of the first transistor, and configured to be turned on when the scanning signal is supplied to an i-th scanning line of the scanning lines, a plurality of third transistors coupled between a gate electrode of the first transistor and a second electrode of the first transistor, and configured to be turned on when the scanning signal is supplied to the i-th scanning line, a plurality of fourth transistors coupled between an initial power supply and the gate electrode of the first transistor, and configured to be turned on when the scanning signal is supplied to an i−1-th scanning line of the scanning lines, a first capacitor coupled between the first power supply and the gate electrode of the first transistor, and a second capacitor including a second terminal coupled to the first power supply, and a first terminal coupled to a first node between two of the third transistors and to a third node between two of the fourth transistors.

The initial power supply may be configured to have a voltage level that is lower than a voltage level of the data signal.

The scan driver may be configured to supply the emission control signal to an i-th emission control line to overlap in time with the scanning signal supplied to the i−1-th scanning line and the i-th scanning line.

The i-th pixel may further include a fifth transistor coupled between the first power supply and the first electrode of the first transistor, and configured to be turned off when the emission control signal is supplied to the i-th emission control line, and a sixth transistor may be coupled between the organic light emitting diode and the second electrode of the first transistor, and may be configured to be turned on and off together with the fifth transistor.

The i-th pixel may further include a seventh transistor including a first electrode coupled to the first power supply, and a second electrode coupled to a fourth node between two of the third transistors and to a fifth node between two of the fourth transistors, wherein the seventh transistor may be configured to be turned off when the emission control signal is supplied to the i-th emission control line.

A second node between two of the third transistors and the fourth node may be electrically isolated from each other when the third transistors is turned off.

The third node and the fifth node may be electrically isolated from each other when the fourth transistors is turned off.

According to the pixel and the organic light emitting display device of embodiments of the present invention, since voltage in response to the data signal and/or voltage of the first power supply are supplied to the nodes of the transistors located at the leakage path, the leakage current can be minimized or reduced, thereby displaying the image of the desired luminance.

BRIEF DESCRIPTION OF THE DRAWINGS

The accompanying drawings, together with the specification, illustrate exemplary embodiments of the present invention, and, together with the description, serve to explain aspects of embodiments according to the present invention.

DETAILED DESCRIPTION

Figure 1:
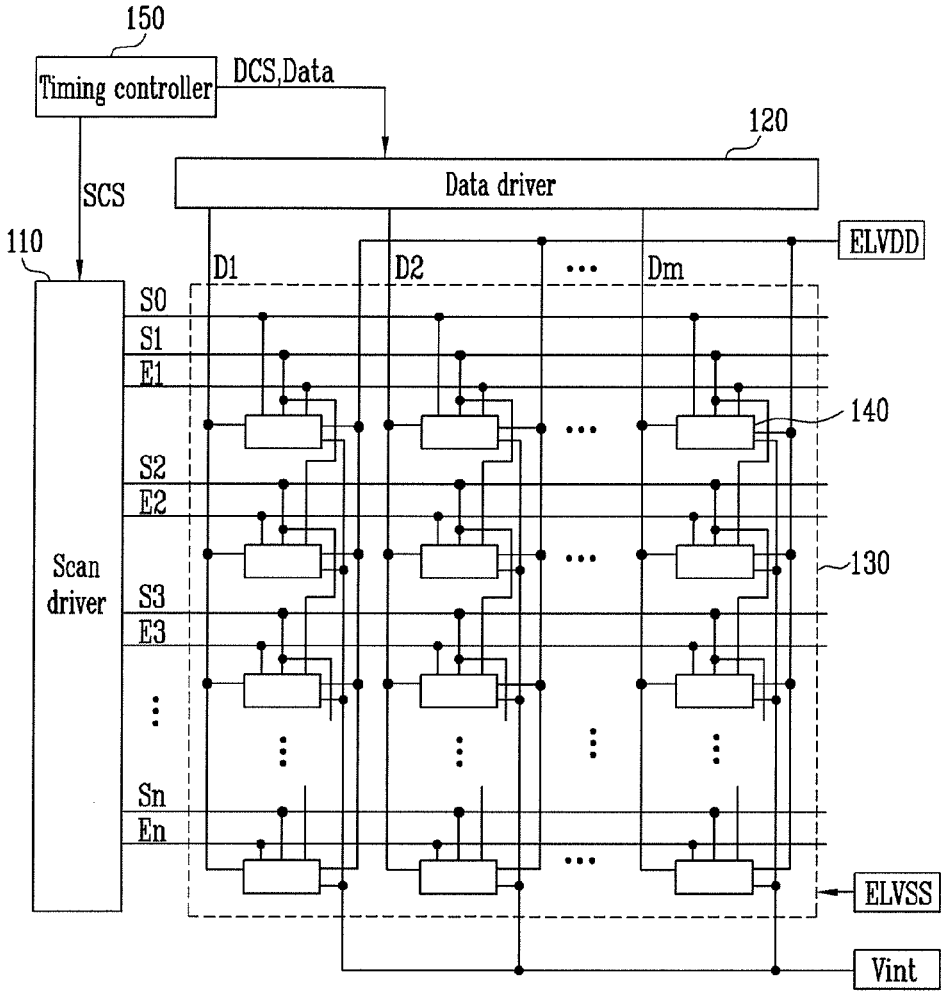
FIG. 1 shows an organic light emitting display device according to an embodiment of the present invention.

A voltage charged in a storage capacitor in a pixel should be maintained constantly in order to display an image of desired gradation. Therefore, at least four transistors may be coupled in series at a leakage current path, thereby preventing or reducing the change of the voltage in the storage capacitor.

For example, a first plurality of transistors may be formed at a first leakage path that is coupled to the storage capacitor, and when a second plurality of transistors is formed at a second leakage path, the first and second plurality of transistors may be formed by coupling at least four transistors in series. However, there is a disadvantage in that even though at least four transistors are coupled at the leakage paths as mentioned above, more than a fixed level of leakage current is generated, so that an image of a desired luminance may fail to be displayed. In addition, the storage capacitor has been formed to have a large capacity to address the conventional level of the leakage current (e.g., a more than fixed level of the leakage current), thereby causing a disadvantageous decrease in aperture ratio.

Hereinafter, certain exemplary embodiments of the present invention will be described with reference to the accompanying drawings. Here, when a first element is described as being connected to or coupled to a second element, the first element may be directly coupled to the second element or may be indirectly coupled to the second element through one or more other elements. Further, some of the elements that are not essential to a complete understanding of the invention are omitted for clarity. Also, like reference numerals refer to like elements throughout.

Hereinafter, embodiments that can be performed by those skilled in the art will be described in more detail with reference to the appended FIGS. 1 to 4.

FIG. 1 shows an organic light emitting display device according to an embodiment of the present invention.

Referring to FIG. 1, the organic light emitting display device according to the present embodiment includes pixels 140 that are arranged to be coupled to scanning lines S0 to Sn, to emission control lines E1 to En, and to data lines D1 to Dm, a scan driver 110 for driving the scanning lines S0 to Sn and the emission control lines E1 to En, a data driver 120 for driving the data lines D1 to Dm, and a timing controller 150 for controlling the scan driver 110 and the data driver 120.

The scan driver 110 is supplied with a scanning driving control signal (SCS) from the timing controller 150. The scan driver 110 that is supplied with the scanning driving control signal (SCS) generates a scanning signal, and supplies (e.g., sequentially supplies) the generated scanning signal to the scanning lines S0 to Sn. In addition, the scan driver 110 supplied with the scanning driving control signal (SCS) generates the emission control signal, and supplies (e.g., sequentially supplies) the generated emission control signal to the emission control lines E1 to En. At this configuration, the emission control signal is supplied to an i-th (here, i is a natural number) emission control line Ei to overlap (e.g., temporally overlap) with the scanning signal that is supplied to an i−1-th scanning line Si-1 and an i-th scanning line Si.

The data driver 120 is supplied with a data driving control signal (DCS) from the timing controller 150. The data driver 120 that is supplied with the data driving control signal (DCS) supplies a data signal to the data lines D1 to Dm when the scanning signal is supplied.

The timing controller 150 generates the data driving control signal (DCS) and the scanning driving control signal (SCS) in response to an externally supplied synchronization signal. The data driving control signal (DCS) generated in the timing controller 150 is supplied to the data driver 120, and the scanning driving control signal (SCS) is supplied to the scan driver 110. In addition, the timing controller 150 supplies the externally supplied data to the data driver 120.

A display unit 130 is supplied with a first power from a first power supply (ELVDD), a second power from a second supply (ELVSS), and an initial power from an initial power supply (Vint), which are then supplied to pixels 140. The pixels 140 allow a gate electrode of a driving transistor to be initialized using the initial power supply (Vint) and control the amount of current that flows to the second power supply (ELVSS) through an organic light emitting diode (OLED) from the first power supply (ELVDD) in response to the data signal. To achieve this, the initial power supply (Vint) is set as a voltage of a level that is lower than that of the data signal. In addition, the first power supply (ELVDD) is set as a voltage of a level that is higher than that of the second power supply (ELVSS).

Figure 2:
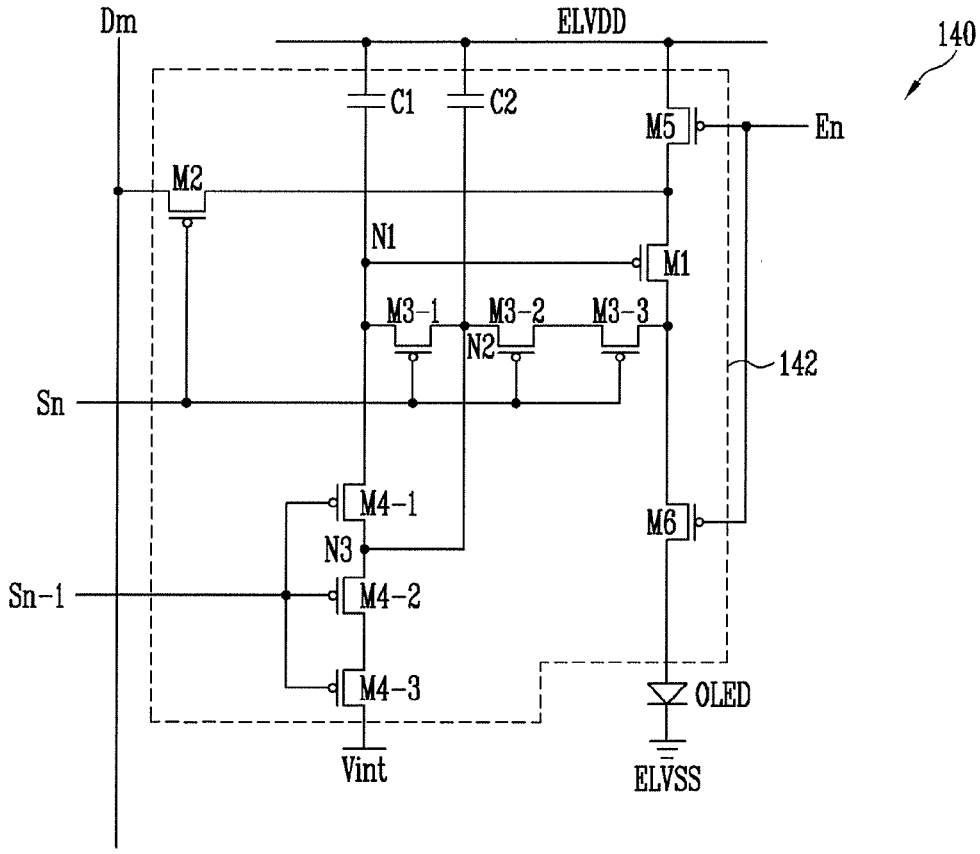
FIG. 2 shows an embodiment of a pixel of the organic light emitting display device depicted in FIG. 1.

FIG. 2 shows an embodiment of a pixel of the organic light emitting display device depicted in FIG. 1. For convenience, a pixel that is coupled to an n−1-th scanning line Sn-1, an n-th scanning line Sn, and an m-th data line Dm is illustrated in FIG. 2.

Referring to FIG. 2, the pixel 140 according to the present embodiment includes a pixel circuit 142 that is coupled to the organic light emitting diode (OLED), to the data line Dm, to the scanning lines Sn-1, Sn, and to the emission control line En, and that can control the amount of current that is supplied to the organic light emitting diode (OLED).

An anode electrode of the organic light emitting diode (OLED) is coupled to the pixel circuit 142, and a cathode electrode of the organic light emitting diode (OLED) is coupled to the second power supply (ELVSS). The organic light emitting diode (OLED) generates light of a fixed luminance in response to a current supplied from the pixel circuit 142.

The pixel circuit 142 is charged a with voltage in response to the data signal, and supplies a current to the organic light emitting diode (OLED) in response to the charged voltage. To achieve this, the pixel circuit 142 includes a plurality of transistors (e.g., a first to a sixth transistors M1 to M6), a first capacitor C1, and a second capacitor C2.

A first electrode of the first transistor M1 is coupled to a second electrode of the fifth transistor M5, and a second electrode of the first transistor M1 is coupled to a first electrode of the sixth transistor M6. In addition, a gate electrode of the first transistor M1 is coupled to a first node N1. The first transistor M1 supplies a current to the organic light emitting diode (OLED) in response to the voltage applied to the first node N1. In this configuration, the first electrode is either a drain electrode or a source electrode, and the second electrode is the other one of the drain and the source electrodes. For example, when the first electrode is set as the source electrode, the second electrode is set as the drain electrode.

A first electrode of the second transistor M2 is coupled to the data line Dm, and a second electrode of the second transistor M2 is coupled to the first electrode of the first transistor M1. In addition, a gate electrode of the second transistor M2 is coupled to the n-th scanning line Sn. The second transistor M2 is turned on to electrically couple the first electrode of the first transistor M1 to the data line Dm when the scanning signal is supplied to the n-th scanning line Sn.

Third transistors M3_1, M3_2, M3_3 are coupled in series between the second electrode of the first transistor M1 and the first node N1. With this configuration, the third transistors M3_1, M3_2, M3_3 are located at a leakage current path coupled to the second power supply (ELVSS) through the organic light emitting diode (OLED) from the first node N1 (e.g., a first leakage path). The third transistors may be formed by coupling at least two transistors in series. The third transistors M3_1, M3_2, M3_3 are turned on to couple the first transistor M1 in a diode type (e.g., diode coupled) when the scanning signal is supplied to the n-th scanning line Sn.

Fourth transistors M4_1, M4_2, M4_3 are coupled in series between the first node N1 and the initial power supply (Vint). At this configuration, the fourth transistors M4_1, M4_2, M4_3 are located at a leakage path coupled to the initial power supply (Vint) from the first node N1 (e.g., a second leakage path). The fourth transistors may be formed by coupling at least two transistors in series. The fourth transistors M4_1, M4_2, M4_3 are turned on when the scanning signal is supplied to the n−1-th scanning line Sn-1 to electrically couple the first node N1 to the initial power supply (Vint).

A first electrode of the fifth transistor M5 is coupled to the first power supply (ELVDD), and the second electrode of the fifth transistor M5 is coupled to the first electrode of the first transistor M1. In addition, a gate electrode of the fifth transistor M5 is coupled to the emission control line En. The fifth transistor M5 is turned on when the emission control signal is not supplied to the emission control line En to electrically couple the first power supply (ELVDD) to the first transistor M1.

The first electrode of the sixth transistor M6 is coupled to the second electrode of the first transistor M1, and a second electrode of the sixth transistor M6 is coupled to the anode electrode of the organic light emitting diode (OLED). In addition a gate electrode of the sixth transistor M6 is coupled to the emission control line (En). The sixth transistor M6 is turned on when the emission control signal is not supplied to the emission control line En to electrically couple the first transistor M1 and the organic light emitting diode (OLED).

The first capacitor C1 is located between the first node N1 and the first power supply (ELVDD). The first capacitor C1 is charged with voltage in response to the data signal.

A second terminal of the first capacitor C1 is coupled to the first power supply (ELVDD), and a first terminal of the first capacitor C1 is coupled to the first node N1. A second terminal of the second capacitor C2 is also coupled to the first power supply (ELVDD), and a first terminal of the second capacitor C2 is coupled to both a second node N2 and a third node N3. The second capacitor C2 is charged with the same voltage as the first capacitor C1. The second node N2 is a node located between two of the third transistors M3_1, M3_2, M3_3 (e.g., between third transistors M3_1 and M3_2) that are coupled in series, and the third node N3 is a node located between two of the fourth transistors M4_1, M4_2, M4_3 (e.g., between fourth transistors M4_1 and M4_2) that are coupled in series.

Figure 3:
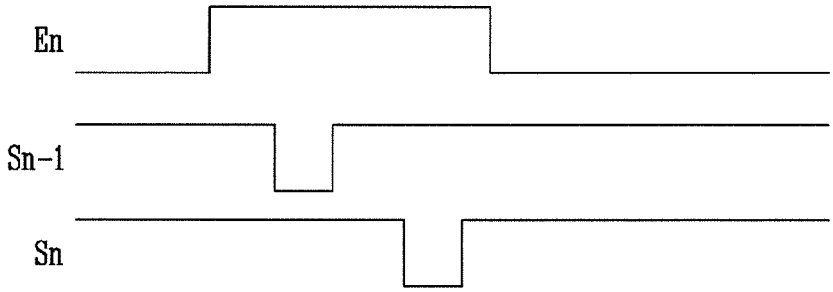
FIG. 3 shows a method for driving a pixel of the embodiment depicted in FIG. 2.

FIG. 3 shows a method for driving a pixel of the embodiment depicted in FIG. 2.

Referring to FIG. 3, the emission control signal is supplied to the emission control line En. When the emission control signal is supplied to the emission control line En, the fifth transistor M5 and the sixth transistor M6 are turned off.

When the fifth transistor M5 is turned off, the first transistor M1 and the first power supply (ELVDD) are electrically isolated (e.g., electrically decoupled) from one another. When the sixth transistor M6 is turned off, the first transistor M1 and the organic light emitting diode (OLED) are electrically isolated (e.g., electrically decoupled) from one another.

After the fifth transistor M5 and the sixth transistor M6 are turned off, the scanning signal is supplied to the n−1-th scanning line Sn-1. When the scanning signal is supplied to the n−1-th scanning line Sn-1, the fourth transistors M4_1, M4_2, M4_3 are turned on. When the fourth transistors M4_1, M4_2, M4_3 are turned on, the first node N1 and the initial power supply (Vint) are electrically coupled, thereby supplying the voltage of the initial power supply (Vint) to the first node N1.

Then, the scanning signal is supplied to the n-th scanning line Sn. When the scanning signal is supplied to the n-th scanning line Sn, the second transistor M2 and the third transistors M3_1, M3_2, M3_3 are turned on. When the second transistor M2 is turned on, the data signal is supplied to the first electrode of the first transistor M1 from the data line Dm.

When the third transistors M3_1, M3_2, M3_3 are turned on, the first node N1 and the second electrode of the first transistor M1 are electrically coupled so that the first transistor M1 is coupled in the diode type (e.g., diode coupled). In this configuration, since the first node N1 is initialized by voltage of the initial power supply (Vint), the first transistor M1 is turned on in response to the data signal supplied to the first electrode of the first transistor M1. When the first transistor M1 is turned on, the voltage that equals the threshold voltage subtracted from the voltage of the data signal is supplied. In this configuration, the capacitor C1 is charged with a voltage (e.g., a fixed voltage) in response to the voltage supplied to the first node N1.

Meanwhile, the voltage supplied to the first node N1 is supplied through the second node N2. Therefore, the second capacitor C2 coupled to the second node N2 is charged with the same voltage (e.g., the fixed voltage) as the first capacitor C1.

Then, the emission control signal stops being supplied to the emission control line En, and the fifth transistor M5 and the sixth transistor M6 are turned on. When the fifth transistor M5 is turned on, the first transistor M1 and the first power supply (ELVDD) are electrically coupled. When the sixth transistor M6 is turned on, the first transistor M1 and the organic light emitting diode (OLED) are electrically coupled. In this configuration, the first transistor M1 controls the amount of current that flows to the second power supply (ELVSS) through the organic light emitting diode (OLED) from the first power supply (ELVDD) in response to the voltage applied to the first node N1.

Meanwhile, the second node N2 and the third node N3 are supplied with the voltage charged in the second capacitor C2 while the current is supplied to the organic light emitting diode (OLED) from the first transistor M1. In this configuration, the voltage charged in the second capacitor C2 is set as the same (or similar) voltage as the voltage charged in the first capacitor C1. In this configuration, the voltages of the first node N1, the second node N2, and the third node N3 are set as the same, thereby minimizing or reducing the leakage currents that flow to the second node N2 and the third node N3 from the first node N1.

Figure 4:
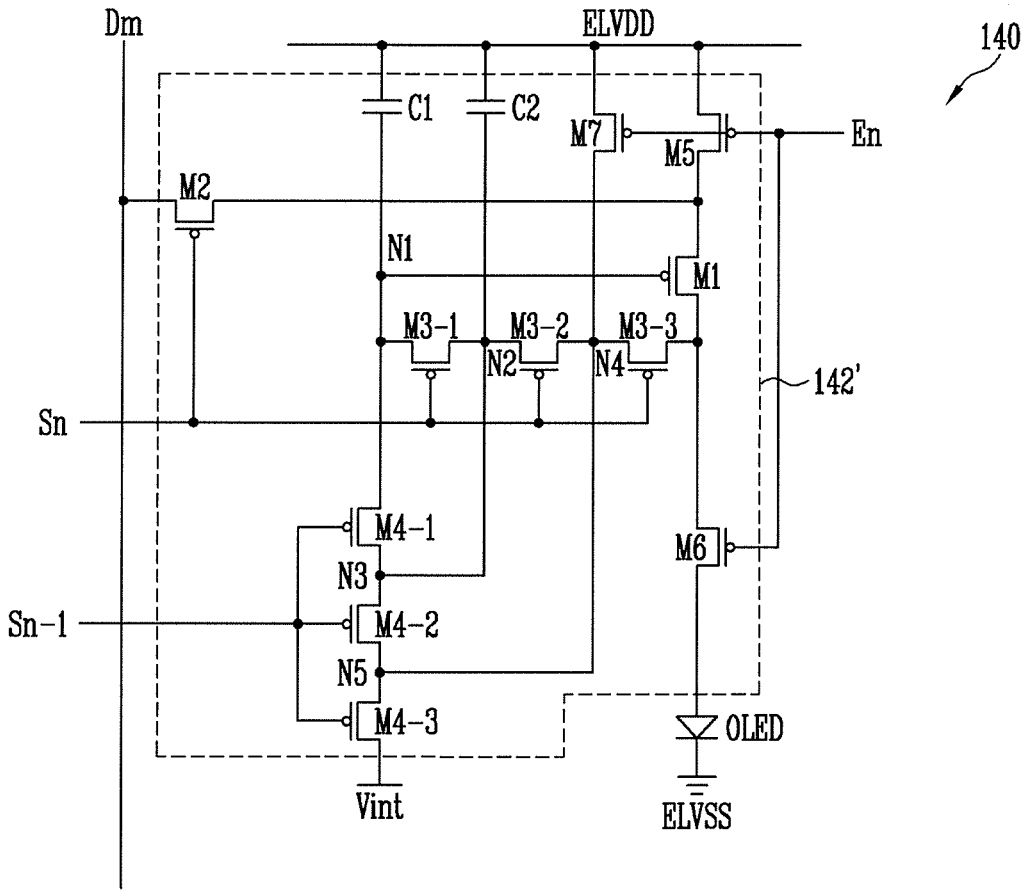
FIG. 4 shows another embodiment of a pixel of the organic light emitting display device depicted in FIG. 1.

FIG. 4 shows another embodiment of a pixel of the organic light emitting display device depicted in FIG. 1. When describing FIG. 4, the elements having the same configuration as those of FIG. 2 have the same reference characters, and a detailed description thereof will not be provided.

Referring to FIG. 4, the pixel 140 according to the present embodiment is coupled to the organic light emitting diode (OLED), to the data line Dm, to the scanning lines Sn-1 and Sn, and to the emission control line En, and includes a pixel circuit 142' for controlling the amount of current that is supplied to the organic light emitting diode (OLED).

The pixel circuit 142' further includes (e.g., in addition to the elements described above in reference to the pixel circuit 142 of the previous embodiment) a seventh transistor M7. A first electrode of the seventh transistor M7 is coupled to the first power supply (ELVDD), and a second electrode of the seventh transistor M7 is coupled to a fourth node N4 and a fifth node N5. With this configuration, the fourth node N4 is a node located between two of the third transistors M3_1, M3_2, M3_3 coupled in series (e.g., between the third transistors M3_2 and M3_3), and the fifth node N5 is a node that is located between two of the fourth transistors M4_1, M4_2, M4_3 coupled in series (e.g., between the fourth transistors M4_2 and M4_3). When the third transistors M3_1, M3_2, M3_3 are turned off, the fourth node N4 is electrically isolated from the second node N2, and when the fourth transistors M4_1, M4_2, M4_3 are turned off, the fifth node N5 is electrically isolated from the third node N3.

The seventh transistor M7 is turned on when the emission control signal is not supplied to the emission control line En, and when turned on, supplies the voltage of the first power supply (ELVDD) to the fourth node N4 and the fifth node N5. In this configuration, while supplying current to the organic light emitting diode (OLED), the second node N2 of the third transistors M3_1, M3_2, M3_3 that are located at the leakage path (e.g., the first leakage path) is supplied with the same voltage as the first node N1, and the fourth node N4 is supplied with a voltage that is of a level that is higher than that of the first node N1. Therefore, while supplying current to the organic light emitting diode (OLED), the leakage current that flows to the organic light emitting diode (OLED) from the first node N1 can be minimized or reduced.

In addition, while supplying current to the organic light emitting diode (OLED), the third node N3 of the fourth transistors M4_1, M4_2, M4_3 that are located at the leakage path (e.g., the second leakage path) is supplied with the same voltage as the first node N1, and the fifth node N5 is supplied with a voltage that is higher than that of the first node N1. Therefore, while supplying current to the organic light emitting diode (OLED), the leakage current that flows to the initial power supply (Vint) from the first node N1 can be minimized or reduced.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A pixel comprising:

an organic light emitting diode comprising a cathode electrode coupled to a second power supply;

a first transistor comprising a first electrode coupled to a first power supply, a second electrode, and a gate electrode, the first transistor being for controlling an amount of current that flows to the second power supply through the organic light emitting diode from the first power supply;

a second transistor coupled between a data line and the first electrode of the first transistor, and configured to be turned on when a scanning signal is supplied to an i-th scanning line, where "i" is a natural number;

a plurality of third transistors coupled between the gate electrode of the first transistor and the second electrode of the first transistor, each of the third transistors being configured to be turned on when the scanning signal is supplied to the i-th scanning line;

a plurality of fourth transistors coupled between an initial power supply and the gate electrode of the first transistor, and configured to be turned on when the scanning signal is supplied to an i−1-th scanning line;

a first capacitor coupled between the first power supply and the gate electrode of the first transistor; and a second capacitor comprising a first terminal coupled to a first node between two of the third transistors and to a third node between two of the fourth transistors, and a second terminal coupled to the first power supply.

2. The pixel as claimed in claim 1, further comprising:

a fifth transistor coupled between the first power supply and the first electrode of the first transistor, and configured to be turned on at a time different than times when the second transistor and the fourth transistors are turned on; and a sixth transistor coupled between the organic light emitting diode and the second electrode of the first transistor, and configured to be turned on and off together with the fifth transistor.

3. The pixel as claimed in claim 1, further comprising:

a seventh transistor comprising a first electrode coupled to the first power supply, and a second electrode coupled to a fourth node between two of the third transistors and to a fifth node between two of the fourth transistors, the seventh transistor being configured to be turned on at a time different than times the second transistor and the fourth transistors are turned on.

4. The pixel as claimed in claim 3, wherein a second node between two of the third transistors and the fourth node are electrically isolated from each other when the third transistors are turned off.

5. The pixel as claimed in claim 3, wherein the third node and the fifth node are electrically isolated from each other when the fourth transistors are turned off.

6. An organic light emitting display device comprising:

a scan driver for supplying a scanning signal to scanning lines and for supplying an emission control signal to emission control lines;

a data driver for supplying a data signal to data lines; and pixels located at crossing regions of the scanning lines and the data lines, wherein an i-th pixel on an i-th horizontal line, "i" being a natural number, comprises:

an organic light emitting diode comprising a cathode electrode coupled to a second power supply;

a first transistor for controlling an amount of current that flows to the second power supply through the organic light emitting diode from a first power supply coupled to a first electrode of the first transistor;

a second transistor coupled between a corresponding data line of the data lines and the first electrode of the first transistor, and configured to be turned on when the scanning signal is supplied to an i-th scanning line of the scanning lines;

a plurality of third transistors coupled between a gate electrode of the first transistor and a second electrode of the first transistor, each of the third transistors being configured to be turned on when the scanning signal is supplied to the i-th scanning line;

a plurality of fourth transistors coupled between an initial power supply and the gate electrode of the first transistor, and configured to be turned on when the scanning signal is supplied to an i−1-th scanning line of the scanning lines;

a first capacitor coupled between the first power supply and the gate electrode of the first transistor; and a second capacitor comprising a second terminal coupled to the first power supply, and a first terminal coupled to a first node between two of the third transistors and to a third node between two of the fourth transistors.

7. The organic light emitting display device as claimed in claim 6, wherein the initial power supply is configured to have a voltage level that is lower than a voltage level of the data signal.

8. The organic light emitting display device as claimed in claim 6, wherein the scan driver is configured to supply the emission control signal to an i-th emission control line to overlap in time with the scanning signal supplied to the i−1-th scanning line and the i-th scanning line.

9. The organic light emitting display device as claimed in claim 8, wherein the i-th pixel further comprises:

a fifth transistor coupled between the first power supply and the first electrode of the first transistor, and configured to be turned off when the emission control signal is supplied to the i-th emission control line; and a sixth transistor coupled between the organic light emitting diode and the second electrode of the first transistor, and configured to be turned on and off together with the fifth transistor.

10. The organic light emitting display device as claimed in claim 8, wherein the i-th pixel further comprises:

a seventh transistor comprising a first electrode coupled to the first power supply, and a second electrode coupled to a fourth node between two of the third transistors and to a fifth node between two of the fourth transistors, wherein the seventh transistor is configured to be turned off when the emission control signal is supplied to the i-th emission control line.

11. The organic light emitting display device as claimed in claim 10, wherein a second node between two of the third transistors and the fourth node are electrically isolated from each other when the third transistors is turned off.

12. The organic light emitting display device as claimed in claim 10, wherein the third node and the fifth node are electrically isolated from each other when the fourth transistors is turned off.

* * * * *

UNITED STATES PATENT AND TRADEMARK OFFICE

CERTIFICATE OF CORRECTION

PATENT NO. : 8,441,421 B2
APPLICATION NO. : 12/963561
DATED : May 14, 2013
INVENTOR(S) : Sam-Il Han et al.

It is certified that error appears in the above-identified patent and that said Letters Patent is hereby corrected as shown below:

In the Claims

| | |
|---|---|
| Column 10, Claim 11, line 42 | Delete "is" |
| | Insert -- are -- |
| Column 10, Claim 12, line 45 | Delete "is" |
| | Insert -- are -- |

Signed and Sealed this
Ninth Day of August, 2016

Michelle K. Lee

Michelle K. Lee
*Director of the United States Patent and Trademark Office*